US007845600B2

(12) United States Patent
Kosich

(10) Patent No.: US 7,845,600 B2
(45) Date of Patent: Dec. 7, 2010

(54) "Y" AXIS DYNAMIC CONE SYSTEM FOR USE WITH A FLEXIBLE SILO, BULK BAG OR FLEXIBLE CONTAINER FILLING OR DISCHARGE APPARATUS

(76) Inventor: Mark Michael Kosich, 7739 Old Raleigh Rd., Bailey, NC (US) 27807

( * ) Notice: Subject to any disclaimer, the term of this patent is extended or adjusted under 35 U.S.C. 154(b) by 136 days.

(21) Appl. No.: 12/217,360

(22) Filed: Jul. 24, 2008

(65) Prior Publication Data

US 2009/0010573 A1 Jan. 8, 2009

Related U.S. Application Data

(60) Provisional application No. 60/958,138, filed on Jul. 3, 2007.

(51) Int. Cl.
*B65B 67/12* (2006.01)

(52) U.S. Cl. ..... 248/95

(58) Field of Classification Search ..... 248/95, 248/97, 694; 222/1, 105, 181.2; 414/304, 414/415; 141/314, 114; 383/22
See application file for complete search history.

(56) References Cited

U.S. PATENT DOCUMENTS

| | | | | |
|---|---|---|---|---|
| 4,527,716 | A * | 7/1985 | Haas et al. | 222/83.5 |
| 5,788,449 | A * | 8/1998 | Riemersma | 414/415 |
| 6,186,360 | B1 * | 2/2001 | Becker et al. | 222/1 |
| 2009/0008410 | A1 * | 1/2009 | Kosich | 222/105 |

* cited by examiner

*Primary Examiner*—Ramon O Ramirez

(57) ABSTRACT

A "Y" axis Dynamic Cone System comprises a plurality of radially extending members having a first pivot mount located in the vicinity of a center point and a second pivot located along the length of the member, a member or pivot compensation means, and means to lift and lower the first pivot end. The invention, for use with a bulk flexible container storage apparatus, filling apparatus or discharging apparatus provides cone or bottom support to a bulk flexible container and provides for a range of angular changes to form a concave "V" cone; level surface; or convex cone shape. The invention may be used to improve the filling efficiency of a flexible bulk container and also to improve and enhance the flow of product from a flexible bulk container.

1 Claim, 8 Drawing Sheets

"Y" AXIS DYNAMIC CONE SYSTEM FOR USE WITH A FLEXIBLE SILO, BULK BAG OR FLEXIBLE CONTAINER FILLING OR DISCHARGE APPARATUS

CROSS REFERENCE TO RELATED APPLICATIONS

U.S. Provisional Application No. 60/958,138, filed on Jul. 3, 2007

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of bulk materials handling and more specifically to an apparatus for use with a flexible silo, stationary or mobile; or flexible bulk container filling apparatus; or flexible bulk container discharging apparatus.

Flexible Silos and Flexible Portable Bins

Silos, bins, hoppers, day bins and portable bins are presently known for use as rigid bulk storage containers for powder and granular product comprising a cone section with an outlet and using a wide variety of valves or flow control devices that can be used to control product flow. A vertical straight side section above the cone section increases the storage capacity. These storage systems are usually constructed with a storage container body made of steel, aluminum or plastic and have a support structure usually constructed of steel or aluminum and sometimes rigid plastic.

It is also known that product flow from such containers can be unreliable. Brute force equipment such as a mechanical agitator, pulsing cone valve or air injector devices can be installed inside the silo or bin cone near the outlet to facilitate product flow. A vibrator mounted on the silo wall can be used to assist product flow from a silo Filling powder or granular product into rigid storage containers often results in blended products becoming unblended and fragile products can be damaged. This results from the free-fall and velocity of product descending from upstream equipment through the empty volume of the container and onto the bottom of the container. Air inside of the empty container mixes with the incoming product yet must be displaced and removed from the container as more product enters. Therefore, displaced air containing airborne product exits the container and is lost to the atmosphere or must be contained and separated using a dust collection system. Product that aerates while transferring into the flexible silo will be less dense resulting in inefficient use of the container volume.

Mobile portable bins that can be transported from one point for filling and to another point for discharging are also known.

Flexible silos fabricated of flexible fabric material for the silo body are a lower cost option to rigid steel or plastic silos and are used similarly in function as rigid storage bins.

The shape and function of the flexible silo and mobile portable flexible bin are designed to mimic the design and function of their rigid counterparts. Although flexible containers offer cost savings over other rigid materials, little to no provision is made take full advantage of the light weight and flexibility of the fabric container. Filling and discharging of product is quite similar for both rigid and flexible bulk containers A flexible silo or bin can be easily collapsed and expanded both in width and in height. While means are sometimes employed to flex the side walls of the flexible container to assist product flow from the container during discharge, no provision is made to take advantage of the ability to reduce and expand the height of the container as a function to minimize free fall and velocity of product entering the container during filling. In addition, no provision is made to jog or pulse the container in a vertical or "Y" plane as a product flow enhancement method.

Further, when filling bulk product into a flexible silo or bin, the material forms a peak in the center of the pile as the product fills the container. As the peak reaches the top of the container, no more product can be added. This peak, known as the material's angle of repose, leads to inefficient use of the container storage volume. A void is created around the top area of the container around the upper perimeter where product cannot reach. Improvement in reducing or eliminating the empty void caused by the material angle of repose when filling a flexible bulk container is needed.

No provision is made to push the flexible silo bottom upward toward the inlet to expel most or all of the air. And, no provision is made to lower the bottom away from the inlet while dense, non-aerated product fills the container.

Improvement in reducing or eliminating the empty void caused by the material's angle of repose when filling a flexible bulk silo or bin is needed. To facilitate product flow from a flexible silo or bin, mechanical agitation means such those seen used on bulk bag discharging equipment can be employed. However, air injection type flow aids are more commonly used. Air injected into a container to facilitate product flow must be evacuated, thereby, resulting in additional pollution control equipment and loss of product. An alternative to injecting air into the container is to use two-ply fabric silo construction. The bottom or cone section of a flexible silo has two plies of fabric, an inner ply and an outer ply with an air gap in between. Air is injected into the space between the two plies to deform the inner ply and apply pressure to the product stored within the flexible silo and to change the shape of the interior ply wall. This approach requires airtight materials and seam construction and very heavy duty fabric. There is an associated increase in container cost. In addition, air line connections and power source connections preclude this design from practical use for mobile portable bins.

Utilizing the vertical flexibility of the flexible bulk container to enhance product flow is not considered in present method flexible silo and bin design. Improvement in utilizing the vertical flexibility of a flexible silo or bin for enhancing product flow from the container is needed.

Further still, although flexible mobile portable bin designs are presently utilized, improvement in providing product flow enhancing means and maintaining practical mobility and ease of use is needed.

Bulk Bag Filling

Bulk bags with lifting loops or sleeves attached to the upper perimeter of the bag can be used as replaceable, disposable storage containers. They require associated bulk bag filling and discharging equipment. Common practice involves filling a bulk bag at one location and transporting it for use and discharge at another location.

When filling bulk bags with bulk product, the material's angle of repose results in inefficient use of the container storage volume. In addition, bulk bags, after they are filled are often stacked two to three bags high. The peak of material interferes with stable stacking of the containers.

Three types of apparatus in which the base support table of a bulk bag filling apparatus can be raised and lowered to address this issue are disclosed in U.S. Pat. Nos. 4,718,464; 5,336,853 and 7,165,498. A described in the patents, a cone shaped table positioned within the base of the bulk bag filling apparatus is raised upward into the lower portion of a bulk bag by a lifting means which creates an indentation in the bag bottom. After the container is mostly filled with product, the lift table is lowered which relaxes the indentation in the bag bottom. The peak of the angle of repose of the product will also relax downward as the lift table lowers which results in a level surface of product in the container. At least one vibrator can be housed under the lift table to induce vibration into the product as a means to separate air from the product inside the bulk bag.

In carrying out the inventions, the filled bulk bag must remain suspended above the lift table because the cone shaped table is not broad enough and it does not provide a stable base to release the filled bulk bag onto. The suspended filled bulk bag must be removed by a fork lift having a pallet on the fork tines or by an automated platform that travels on rails into the space between the suspended bulk bag and the lowered cone lift table. Once one of these platforms is positioned under the bulk bag, the filled bulk bag can be released onto the platform and then removed from the bulk bag filling apparatus.

A simpler, more efficient means to reduce the peak formed by the angle of repose and a simpler, more efficient means to release a filled bulk bag onto a level platform is needed.

Bulk Bag Discharging

To discharge the bulk material stored within a bulk bag, the filled bulk bag is hoisted onto a bulk bag discharging apparatus. The apparatus provides loop or sleeve supports for suspending the bulk bag.

Bag squeezing devices mounted along the sides of the discharger frame are sometimes used to assist with product flow from the container. The most common flow assist apparatus utilizes at least two inclined panels, each positioned opposite the other. The panels provide a base for the product filled bag to rest upon and have a gap between the inner edges for the bag outlet spout to pass through. Each panel has a stationary pivot located at the inner base end with a piston and cylinder type actuator having one end pivot mount at a point along the panel and a second end pivot mount on the structure. When the actuators extend, the base mounts pivot and remain level as the outer ends of the panels arc inward thereby applying pressure against the bag. As product leaves the bag, the actuators move the upper ends of the panels further inward in an arc motion to increase the angle of the base of the bulk bag. The actuators can also be pulsed to provide agitation to the product to assist product flow.

It is also known that a flexible silo or bulk bag, when supported from the top, needs to be lifted as product discharges because the cube shaped flexible container narrows in width and elongates.

A hoist lift or other bag lifting mechanism can be used to support the loops or sleeves of the bulk bag which can be raised up incrementally as product leaves the container to compensate for elongation and to keep the lower portion of the bag and bag bottom walls as vertical as possible to allow product to exit the container.

Inclined panels having fixed base pivot mounts are an effective means of gradually increasing the angle of the sides of a bulk bag as product leaves the container. However, because the base of the flexible bulk bag remains level, in the case of no product flow, the actuators squeeze and compact the product stored in the container.

An improved means to change the angle the bulk bag base support members and to maintain tension on the flexible container as it elongates as product vacates the container is needed.

A means to enhance product flow from a filled bulk bag yet avoid squeezing the product stored within the container is needed.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

A detailed description of the invention is provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
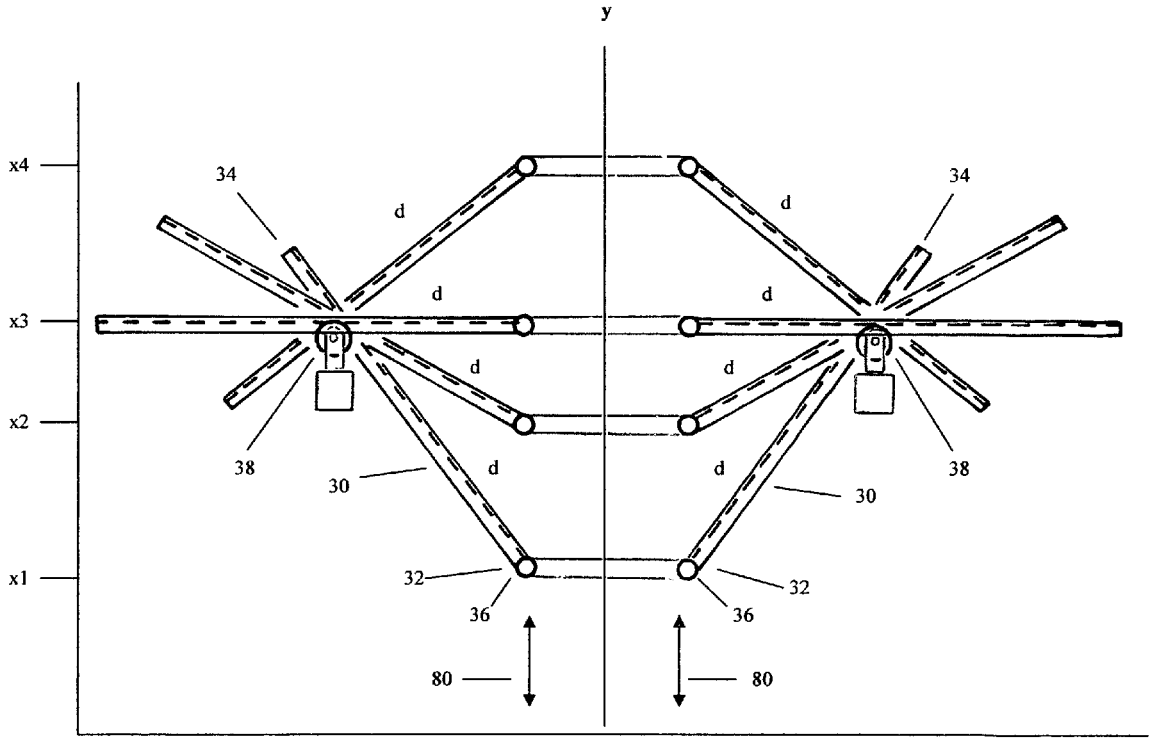
FIG. 1 is a side view composite of range of motion of the invention.

The invention is designed to support the cone section or bottom of a flexible silo, bulk bag or flexible container as an integrated component to a flexible silo apparatus, bulk bag filling or discharging apparatus or flexible container filling or discharging apparatus. Turning first to FIG. 1, there is shown a composite sketch that illustrates the invention by showing two radially extending members 30 with each member extending radially from center and having two opposed ends and at least two pivot points. A first or base end 32 comprises a first pivot means 36 located in the vicinity of a center point that is between the first base end 32 of each radially extending member 30. A second end 34 of member 30 extends radially from the center point. A second pivot means 38 is located at or in the vicinity of a given point along the length of member 30. Second pivot 38 can mount to the structure or components of the structure of a flexible silo apparatus, bulk bag filling or discharging apparatus or flexible container filling or discharging apparatus.

A wide range of lifting and lowering devices 80 may be used and a partial exemplary list of desirable mechanisms may include pneumatic or hydraulic actuating cylinder device, screw jack, air bellows actuator and scissor lift. Pivot 36 can mount in a number of ways. Pivot 36 can mount directly to a component of lifting and lowering device 80, or to a component that is driven by lifting and lowering device 80. In turn, lifting and lowering device 80 can mount independently or mount integrally with the structure provided by a flexible silo apparatus, bulk bag filling or discharging apparatus or flexible container filling or discharging apparatus.

It is an important aspect of the invention that a lifting and lowering device, shown as double vertical arrows 80, will lift and lower the first base end 32 of member 30 vertically along a "y" axis. When lifting and lowering, device 80 moves the first end 32 vertically along axis "y", second end 34 moves in an arc motion. Second end 34 moves in downward arc while first end 32 moves upward. Second end 34 moves in an upward arc as first end 32 moves downward. In doing so, the support structure provided by radially extending members 32 moves through an infinite range of angular positions thereby changing form into various support structure forms. Several positions are shown with first end 32 at several "x" axis points including a concave "V" cone structure (x1, x2), a level support structure (x3) and a convex cone or pyramid shape (x4).

It is an important point to consider however, that as first end 32 moves upward vertically from level x1 to level x3, the distance "d" between first pivot point 36 and second pivot point 38 gradually decreases. As first end 32 is raised further beyond level x3, the distance "d" between pivot point 36 and 38 increases. This is based on first pivot point 36 moving on a fixed vertical axis "y" while second pivot point 38 remains fixed. Therefore, a compensation means is required to allow radially extending member 30 to successfully move through the required range of motion.

Figure 2:
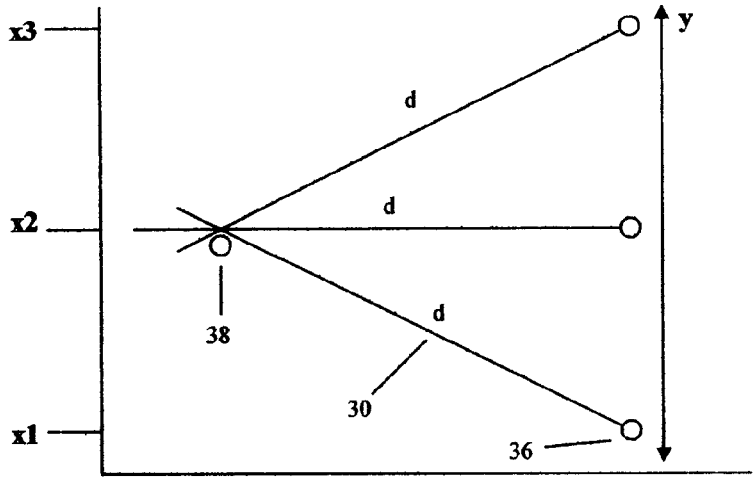
FIG. 2 is a side view composite of range of motion of the invention.
Figure 3:
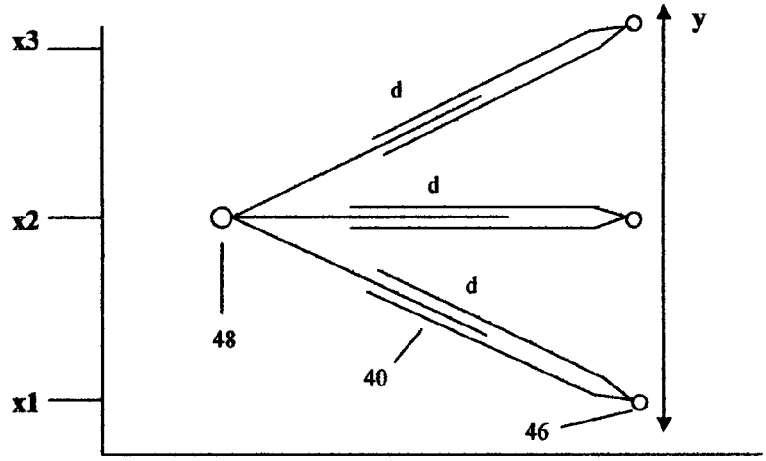
FIG. 3 is a side view composite of range of motion of the invention.
Figure 4:
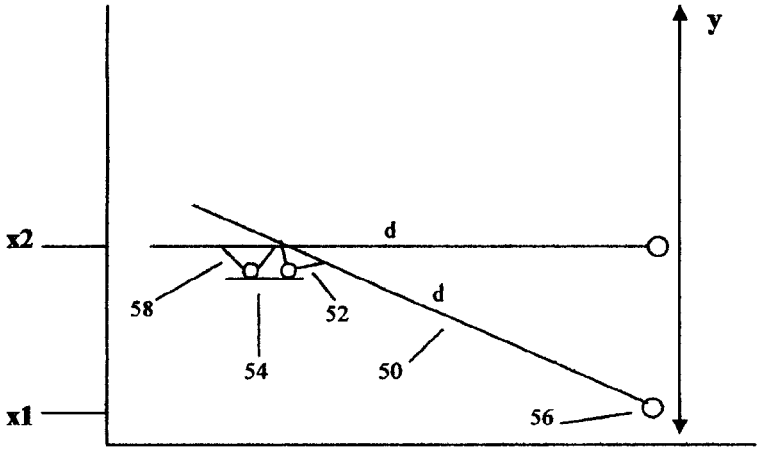
FIG. 4 is a side view composite of range of motion of the invention.

Now turning to FIGS. 2-4 there is shown a series of descriptions of three different compensation means.

First in FIG. 2, radially extending member 30 is represented as a fixed length member. A variable pivot means 38 provides for a fixed mounting location with further means providing a variable relationship with fixed length member 30. This allows radially extending member 30 to move back and forth along the fixed pivot position, thereby providing compensation for the change in distance "d" between pivot point 36 and 38 as pivot point 36 moves vertically through exemplary "x" axis points x1, x2 and x3

In FIG. 3, radially extending member 40 is represented as a variable length member wherein member 40 can expand and contract in length. A radially extending member of such design can contract in length as pivot point 46 moves vertically through exemplary "x" axis points x1, x2 and can expand in length as it moves beyond "x" axis point x3, thereby providing compensation for the change in distance "d" between pivot point 46 and 48.

Further, in FIG. 4, radially extending member 50 is represented as a fixed length member. A variable pivot point 52 having a fixed mounting 54 to member 50 is shown having a variable relationship with its support mount 54, thereby providing compensation for the change in distance "d" between pivot point 56 and 58 as first pivot point 56 moves vertically through exemplary "x" axis points x1 and x2 and allows radially extending member 50 to move back and forth. "x" axis points above x2 are not shown to help simplify the illustration of the variable pivot.

Figure 5:
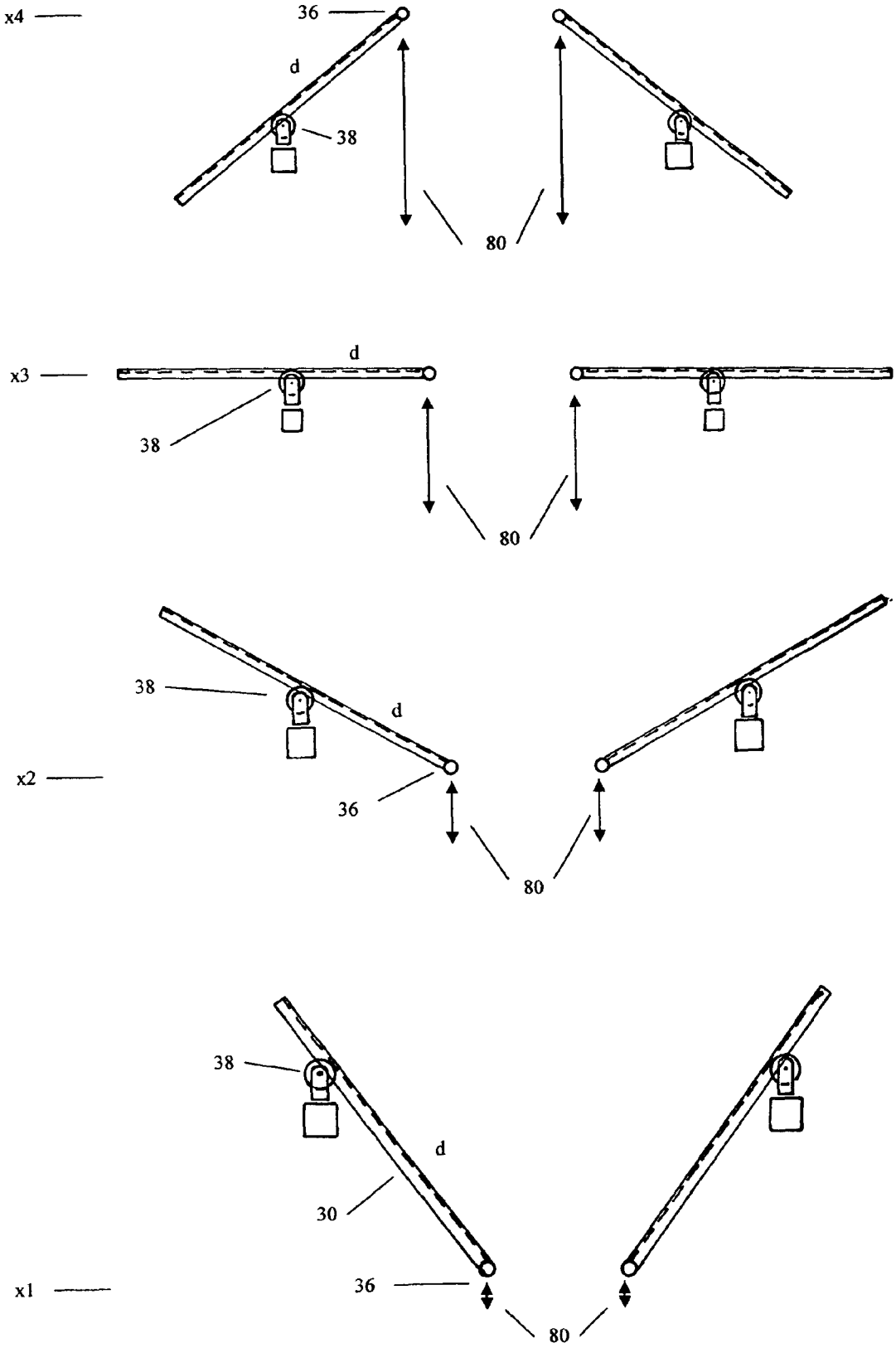
FIG. 5 is a side view sequence of range of motion of the invention.

FIG. 5 shows another perspective of the invention as described in FIGS. 1 and 2. While it should be understood that radially extending members 30 are capable of moving through an infinite range of positions from a fully lowered position to a fully raised position, for the simplicity of illustrative purposes four separate positions represented by "x" axis points x1 through x4, are shown. These same positions were shown in FIG. 1 as a composite and are shown separately here in FIG. 5. Lifting and lowering device 80 is shown moving first pivot point 36 vertically along the "y axis to "x" axis points x1, x2, x3 and x4.

The invention has radially extending member 30 as a fixed length channel member and a second fixed pivot point means 38 shown as a rolling type bearing, and having a variable relationship with fixed length member 30. The rolling bearing is shown within the channel guide of member 30 with member 30 riding over the rolling bearing. The compensating movement of member 30 along variable pivot means 38 can be more clearly seen with the distance "d" between pivot points 36 and 38 changing as first pivot point 36 is raised from lowered position x1, which provides a concave cone shape; to partially raised position x2, which provides a lesser angle concave cone shape; further to position x3, which shows a level support structure; and finally to high position x4, which shows a convex, pyramid shape.

Figure 6:
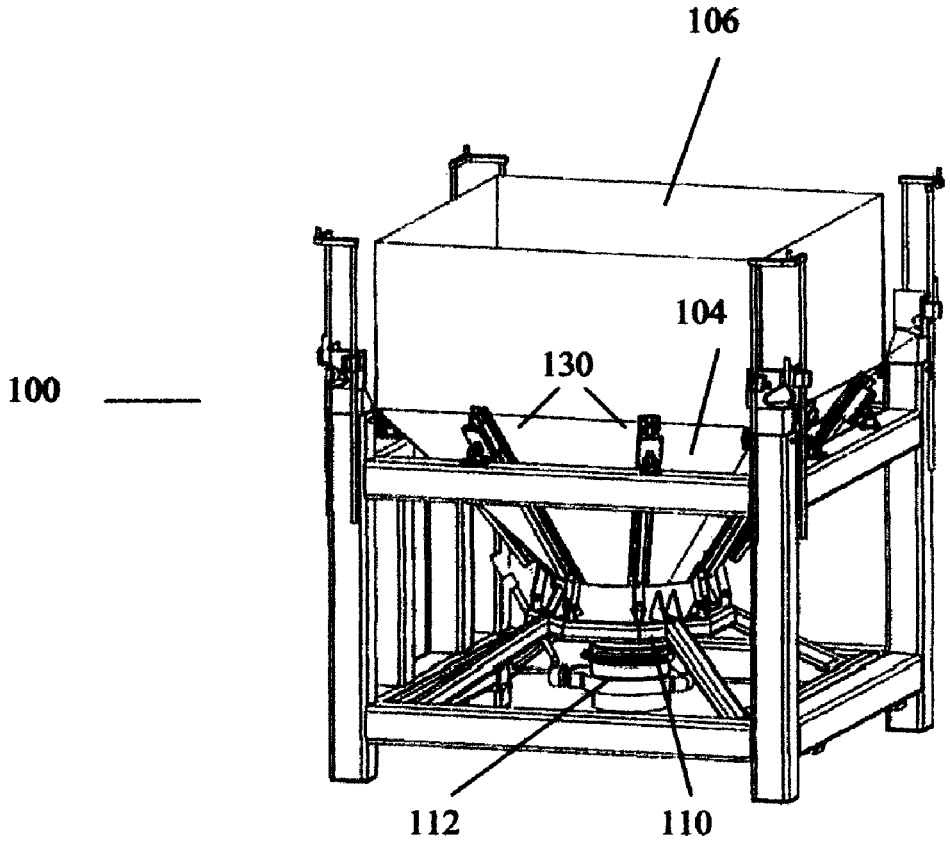
FIG. 6 is a perspective view of an exemplary application of the invention.
Figure 7:
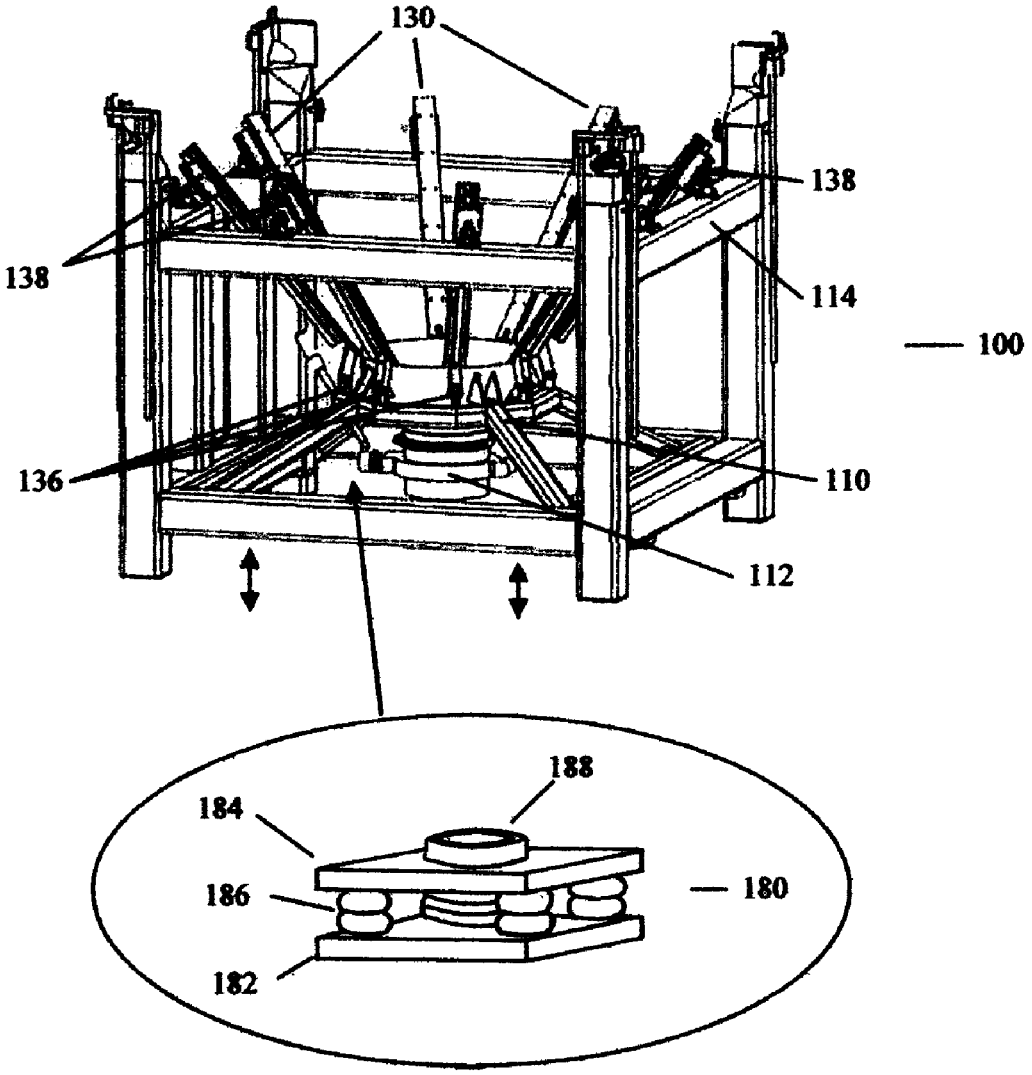
FIG. 7 is a perspective view of an exemplary application of the invention.
Figure 8:
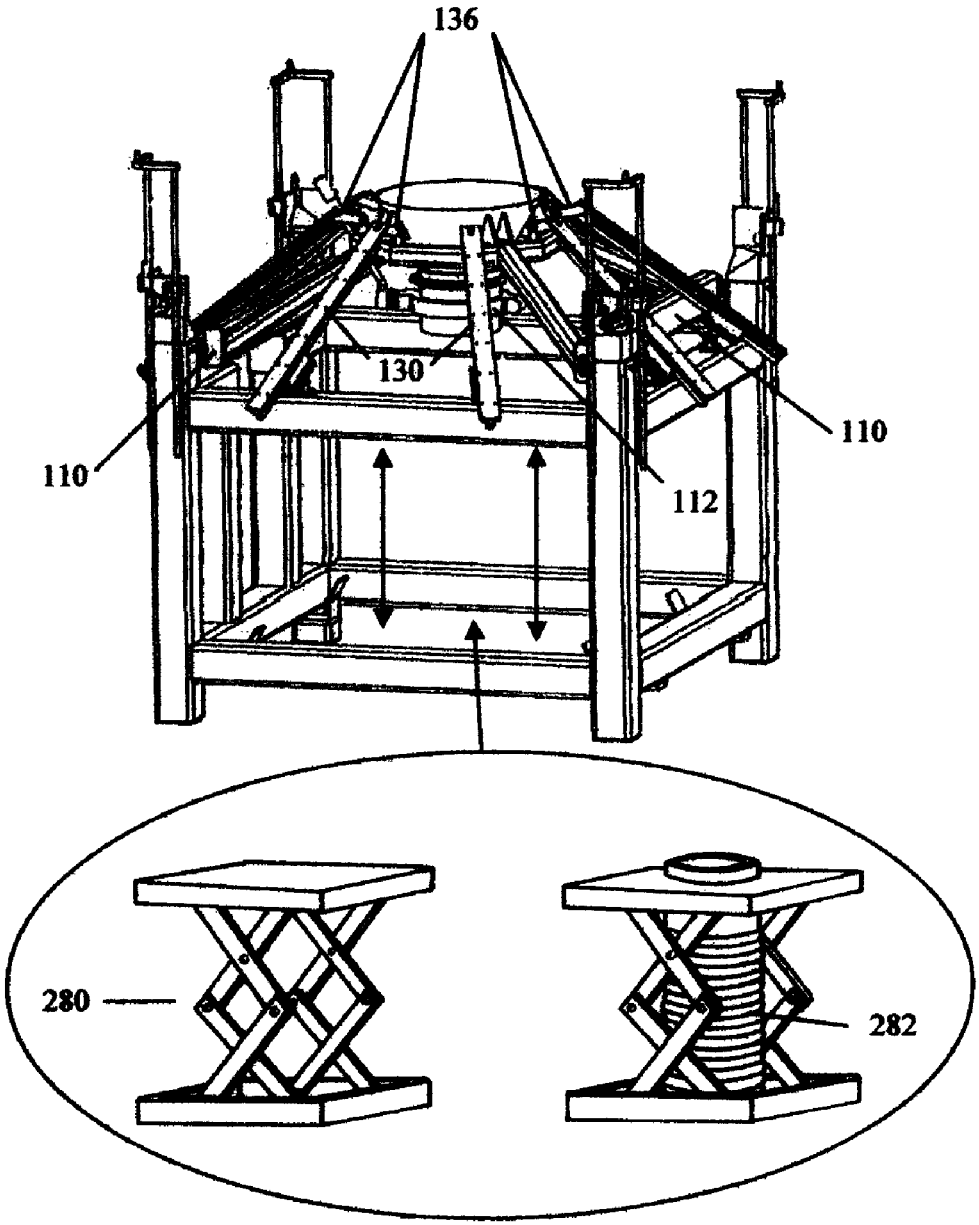
FIG. 8 is a perspective view of an exemplary application of the invention.

In carrying out the present invention, as shown in FIGS. 6 through 8, I provide illustrations of an exemplary apparatus to further support how the invention relates to its use with a flexible silo apparatus.

In FIG. 6, a flexible silo apparatus 100, disclosed in U.S. patent application Ser. No. 12/217,428, is shown with the invention providing support to the cone section or bottom 104 of a flexible silo 106. A flexible silo apparatus 100 has a top removable valve assembly 112 that has components to interface with the outlet of a flexible container 106 and that can be supported upon a floating bridge 110. A plurality of radially extending members 130 is shown in a lowered position to provide support to the cone section or bottom 104 of the flexible silo 106.

FIG. 7 shows the invention integrated into the design of the flexible silo apparatus 100. The flexible silo 106 is not shown to show the present invention more clearly. In the illustrated design, eight radially extending members 130 each have a first pivot means 136 mounting upon a suspended floating bridge 110. A second pivot point 138 mounts upon a member of structure 100 and is shown as horizontal support member 114. The plurality of radially extending members 130 provides a cone support which provides a resting base for the flexible container which, in turn, reduces the strain caused by the weight of product stored within the flexible silo. The apparatus, enhanced with a floating bridge 110 and the addition of a powered lifting and lowering device 180 provides the advantage of manipulating the flexible container in a vertical motion for improving the filling of product into or the discharging of product out of a flexible container.

Suspended floating bridge 110 rests unfixed upon the structure of the apparatus 100. Lifting and lowering action of device 180 engages suspended floating bridge 110 for the purpose of raising first pivot point 136 along a "y" axis. Lifting and lowering device 180 is shown with air bellow actuators 186. A wide range of lifting and lowering devices 180 may be used and a partial exemplary list of desirable mechanisms may include pneumatic or hydraulic actuating cylinder device, screw jack, air bellows actuator and scissor lift. The illustration shows lifting and lowering device 180 having a stationary base 182 and a top structure 184 that can be moved vertically by air bellows 186 and top structure 184. Such a design provides an exemplary means of pulsing first pivot point 136 up and down to change the slope angle of the cone shape of radially extending members 130 thereby providing a vertically acting flow aid to help product stored within the flexible silo to discharge from the container. A flexing bellows connection 188 may also be provided to provide a dust tight connection through which product may flow.

Further as shown in FIG. 8, a high lifting and lowering device 280 may be utilized to provide a wider range of motion of the invention thereby providing an improved means for filling a flexible silo or flexible bulk container. A flexing bellows connection 282 may also be provided to provide a dust tight connection through which product may flow. The present invention allows us to take full advantage of the light weight and flexibility of the fabric container. A flexible silo or bin can be easily collapsed and expanded both in width and in height. The present invention provides provision to take advantage of the ability to reduce and expand the height of the container as a function to minimize free fall and velocity of product entering the container during filling. High lifting and lowering device 280 engages floating bridge 110 for the purpose of raising first pivot point 136 along a "y" axis. Lifting and lowering device 280 is shown as a scissor type lift. First pivot point 136 is raised to a high level which forms radially extending members 130 into convex pyramid shape and elevates valve 112 thereby reducing the vertical space of the flexible container and providing for the reduction of freefall and velocity of product as it enters the flexible container during filling. Segregation of blended product and damage to fragile product can be reduced or eliminated. Air born dust can also be minimized or eliminated.

Figure 9:
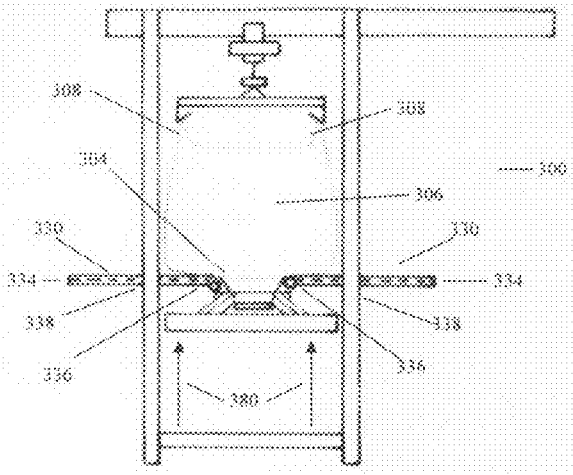
FIG. 9 is a side view of an exemplary application of the invention.
Figure 9A:
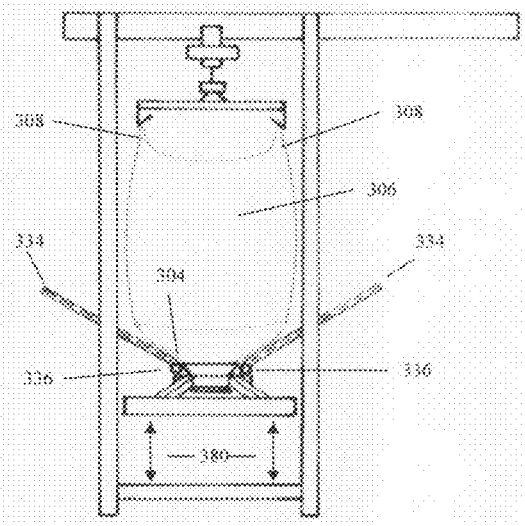
FIG. 9A is a side view of an exemplary application of the invention.
Figure 9B:
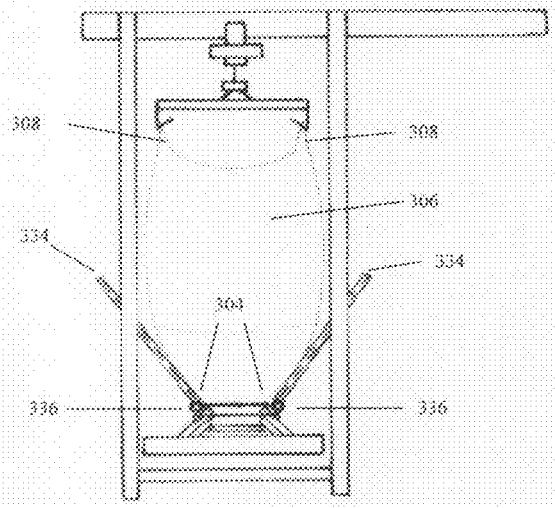
FIG. 9B is a side view of an exemplary application of the invention.

In carrying out the present invention, as shown in FIGS. 9 through 9B, I provide illustrations of an exemplary apparatus to further support how the invention relates to its use with a bulk bag or flexible bulk container discharging apparatus.

Those skilled in the art will recognize the common design of a bulk bag discharging apparatus as a structure to support a bulk bag by loops or sleeves that are located in the vicinity of the upper perimeter of the body of a bulk bag. An outlet spout on the bottom of the bulk bag can be opened to allow product to flow and exit the container. A wide range of bag outlet connectors are available that help contain dust and provided for mounting a valve or flow control device.

This discussion relates to two different present method devices that are mounted upon a bulk bag discharging apparatus and are used to improve the handling of the flexible bulk bag and to enhance product flow through the bulk bag outlet.

It is also recognized by those skilled in the art that most bulk bags are fabricated to form a generally cube shape when filled with product. Cubes are more efficiently arranged for shipping and storage. It is common practice to provide lower bag agitators or bag flexors that utilize at least two inclined panels, each positioned opposite the other and supported on the discharger structure. The panels provide a base for the product filled bag to rest upon and have a gap between the inner edges for the bag outlet spout to pass through. Each panel has a stationary pivot located at the inner base end with a piston and cylinder type actuator having one end pivot mount at a point along the panel and a second end pivot mount on the structure. When the actuators extend, the base mounts pivot and remain level as the outer ends of the panels arc inward thereby applying pressure against the bag. As product leaves the bag, the actuators move the upper ends of the panels further inward in an arc motion to increase the angle of the base of the bulk bag. The actuators can also be pulsed to provide agitation to the product to assist product flow. The increasing angle of the agitators also helps provide a steeper slope of the bag base area and further facilitates product flow from the bag.

It is also known that a flexible silo or bulk bag, when supported from the top, needs to be lifted as product discharges because the cube shaped flexible container narrows in width and elongates.

A hoist lift or other bag lifting mechanism can be used to support the loops or sleeves of the bulk bag which can be raised up incrementally as product leaves the container to compensate for elongation and to keep the lower portion of the bag and bag bottom walls as vertical as possible to allow product to exit the container.

Looking at FIGS. 9 through 9B, the present invention is shown as a means to address the concerns discussed above. As shown in FIG. 9, an exemplary bulk bag discharging apparatus 300 is shown with bulk bag 306 suspended by loops 308. Bulk bag 306 when filled has a generally cube shape and is shown with the base 304 resting upon radially extending members 330 of the present invention. A lifting and lowering mechanism is represented by double arrows 380. A wide range of lifting and lowering devices 380 may be used and a partial exemplary list of desirable mechanisms may include pneumatic or hydraulic actuating cylinder device, screw jack, air bellows actuator and scissor lift. Lifting and lowering device 380 has first pivot point 336 raised to a level where radially extending members are generally horizontal providing a base for bulk bag 306. Once bulk bag is in position on apparatus 300 and the outlet is prepared for discharging product, the outlet may be opened to allow product to flow.

Moving along to FIG. 9A, it can be seen that as product exits bulk bag 306, bulk bag 306 begins to lose its cube shape and elongates. The present invention with lifting and lowering means 380 gradually lowers first pivot point 336 along a vertical axis causing radially extending members 330 to form a concave cone shape thereby providing an increasing angle for the bulk bag base 304. In addition, as bulk bag 306 elongates, the lowering of bulk bag base 304 maintains tension on the top supported loops 308.

Lifting and lowering means can impart a pulsing raising and lowering motion to first pivot points 336 to provide a vertically acting product flow enhancement means. By pulsing vertically, radially extending members 330 change the angle of the cone shape which disrupts bridging formations in the product. Upward force is provided by lifting and lowering means 380 and gravity provides downward force. Because the second end 334 of radially extending members 330 arc downward when upward vertical force applied to first pivot 336, the product is not squeezed thereby avoiding compaction to the product and damage to fragile product.

Continuing to FIG. 9B, a mostly emptied bulk bag 306 is shown with a steeply inclined base 304 provided by the further lowering of first pivot points 336 forming a concave cone shape with steeply inclined radially extending members 330. Tension is maintained on top supported loops 308 and along the length of the bulk bag 306. Therefore, the present invention offers provision for bag tensioning as product exits the container and also provides flow enhancement of product from the flexible container.

Figure 10:
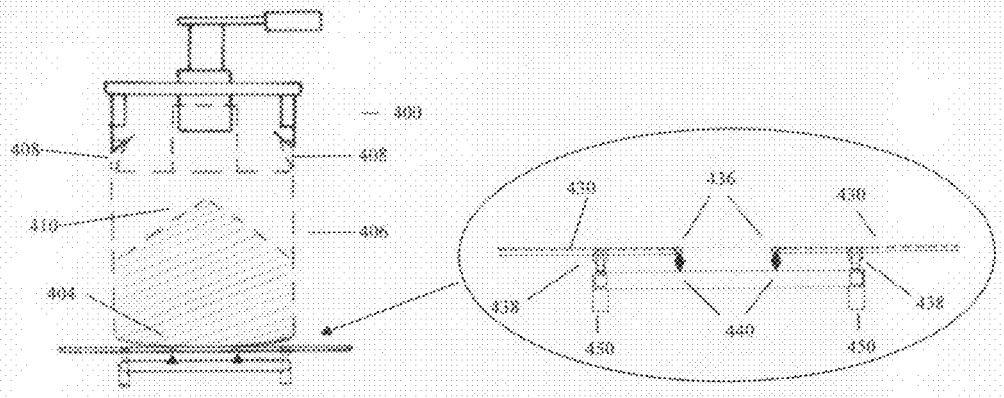
FIG. 10 is a side view of an exemplary application of the invention.
Figure 10A:
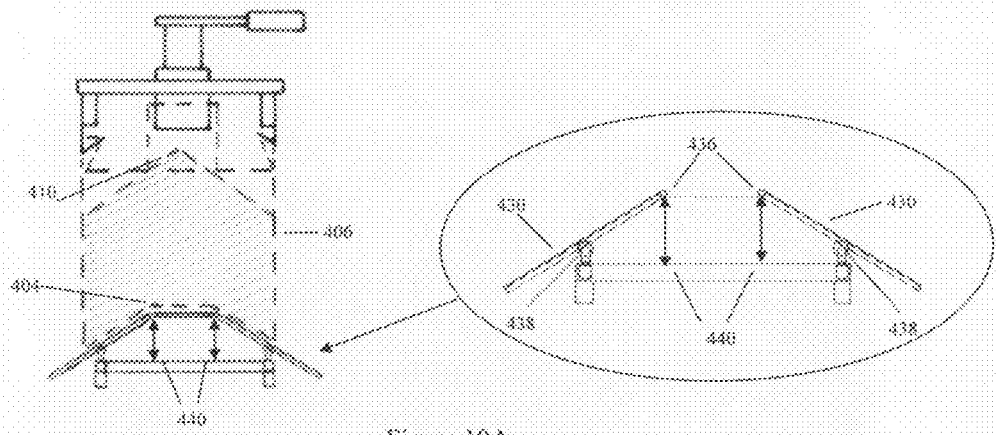
FIG. 10A is a side view of an exemplary application of the invention.
Figure 10B:
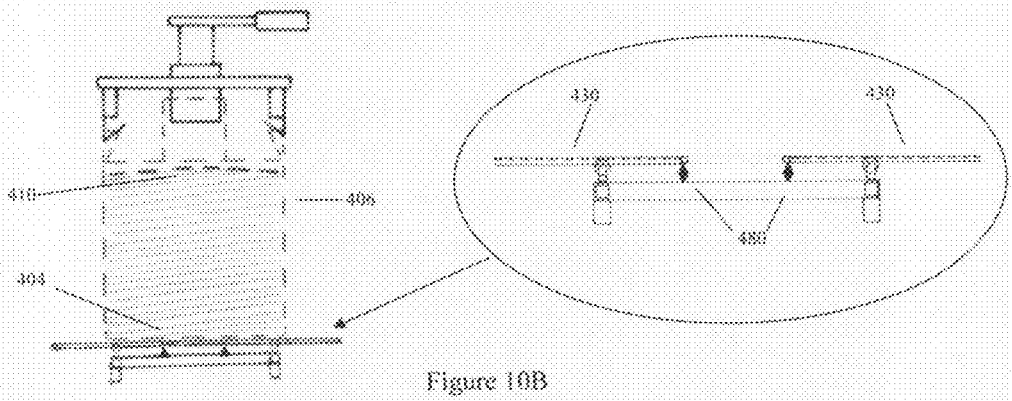
FIG. 10B is a side view of an exemplary application of the invention.

In carrying out the present invention, as shown in FIGS. 10 through 10B, I provide illustrations of an exemplary apparatus to further support how the invention relates to its use with a bulk bag or flexible container filling apparatus.

Those skilled in the art will recognize the common design of a bulk bag or flexible container filling apparatus as a structure to support a bulk bag by loops or sleeves that are located in the vicinity of the upper perimeter of the body of a bulk bag. An inlet spout on the top of the container can be opened and fitted to and inlet chute to allow product to flow into the container. A wide range of bag inlet connectors are available that help contain dust and provision is usually made for mounting a valve or flow control device to start, stop and control the flow of product into the flexible container.

This discussion relates to a device that is positioned at the base of a bulk bag filling apparatus and is used to improve the filling of the flexible container to achieve a completely filled container and to address the peak of product that forms on the surface of the product commonly referred to as the material's "angle of repose".

It is also recognized by those skilled in the art that most bulk bags are fabricated to form a generally cube shape when filled with product. Cubes are more efficiently arranged for shipping and storage and often are stacked two or three high. It is therefore advantageous to address the concerns of providing a well shaped cube container with a level surface of product.

Three types of apparatus in which the base support table of a bulk bag filling apparatus can be raised and lowered to address this issue are disclosed in U.S. Pat. Nos. 4,718,464; 5,336,853 and 7,165,498. In the three patents, a cone shaped table positioned within the base of the bulk bag filling apparatus is raised upward into the lower portion of a bulk bag by a lifting means which creates an indentation in the bag bottom. After the container is mostly filled with product, the lift table is lowered which relaxes the indentation in the bag bottom. The peak of the angle of repose of the product will also relax downward as the lift table lowers which results in a level surface of product in the container. At least one vibrator can be housed under the lift table to induce vibration into the product as a means to separate air from the product inside the bulk bag. With the three inventions, after the bulk bag is filled with product, the filled bulk bag must be raised or the cone shaped table must be lowered in order to suspend the bulk bag and provide a space between the bulk bag bottom and the top of the cone shaped lift table. The cone shaped table is not broad enough and, because of its cone shape, does not provide a stable base to release the filled bulk bag onto. The suspended filled bulk bag must be removed by a fork lift having a pallet on the fork tines or by an automated platform that travels on rails into the space between the suspended bulk bag and the lowered cone lift table. Once one of these platforms is positioned under the bulk bag, the filled bulk bag can be released onto the platform and then removed from the bulk bag filling apparatus.

Looking at FIG. 10 through 10B, the present invention is shown as a means to address the concerns discussed above.

As shown in FIG. 10, an exemplary bulk bag or flexible container filling apparatus 400 is shown with bulk bag 406 supported by loops 408. A well filled bulk bag or flexible container should be filled completely, free of folds and wrinkles and have a level surface of product. Loops or sleeves 408 are supported in a way to suspend the container to provide for smooth side walls. Bulk bag 406 is shown with the base 404 resting upon radially extending members 430 of the present invention. First pivot 436 or any component thereof is mounted to be driven by lifting and lowering device 480. Second pivot 438, or any component thereof, is mounted upon a structure 450.

Once bulk bag or flexible container 406 is in position on apparatus 400 and the inlet is prepared for filling with product, product is allowed to flow into the container 406. The top level of product is shown forming the peak 410 known as the material's "angle of repose". Lifting and lowering device 480 has first pivot point 436 at a level where radially extending members 430 are horizontal thereby providing a base to engage the bottom 404 of bulk bag or flexible container 406.

Further, as shown in FIG. 10A, a lifting and lowering mechanism is represented by double arrows 480. Lifting and lowering device 480 raises upward and has first pivot point 436 raised to a level where radially extending members 430 form a convex pyramid shape that pushes upward into the lower portion of the bulk bag or flexible container 406 which creates an indentation 440 in the container base 404. A wide range of lifting and lowering devices 480 may be used and a partial exemplary list of desirable mechanisms may include pneumatic or hydraulic actuating cylinder device, screw jack, air bellows actuator and scissor lift.

Finally, as shown in FIG. 10B, as the container is filled with product, lifting and lowering device 480 is lowered which relaxes the indentation 440 in the bag base 404. The peak 410 of the "angle of repose" of the product will also relax downward which results in a level surface of product in the container.

It is a further advantage to utilize the invention as a means to increase the packed density of the product stored within the bulk bag 406. Multiple vertical pulses of the lifting and lowering device 480 provide low frequency, high amplitude agitation to the product stored within the bulk bag 406. High amplitude pulsation is more effective in dislodging air from product at higher levels in the container. It is known that high frequency, low amplitude vibration induced through the bottom of a bulk bag as a means of increasing the packed density of the stored product is only effective for the product in the lower portion of the container. The low amplitude energy of high frequency vibration is quickly absorbed by the product in the lower portion of the container.

Therefore, the present invention offers provision for reducing or eliminating the peak known as the material's "angle of repose and further provides for more effectively increasing the density of the product when filling powder and granular products into a bulk bag.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A "Y" axis dynamic cone system for use with a flexible a silo, bulk bag or flexible container filling or discharging apparatus comprises a plurality of radially extending members, to support the cone section or bottom of a flexible silo, bulk bag or flexible container, having two opposed ends with a first or base end, and a second end;

means for mounting said plurality of radially extending members with at least two pivot means, comprising a first and second pivot means, that will allow the changing of the angle of said radially extending members, wherein said first or base end, or component thereof, has a first pivot means located in the vicinity of a center point located between said first or base ends of said radially extending members, with said second end extending radially from said center point, and said second pivot means located in the vicinity of a given point along the length of said radially extending member;

means to mount said first or base pivot end, or any component thereof;

means to support said means to mount said first or base pivot end, or any component thereof;

means to provide said second pivot point at a given point along said radially extending member;

means to mount said second pivot point means;

means to support said means to mount said second pivot means;

compensation means for said second pivot point means to provide one of the following:

a) a variable pivot means located along said radially extending member, wherein said member can move back and forth along said second pivot means;

b) a variable pivot mount position; wherein said pivot mount can move back and forth; or c) a variable length of said radially extending member between said first and second pivot points, wherein the length of said radially extending member can expand and contract;

thereby allowing said first pivot end to move vertically along a fixed "y" axis and said second end to move in an arc motion providing for a range of angular changes of said radially extending members to form a concave "V" cone, flat surface or convex cone or pyramid shape; and means to lift and lower said first or base end of said radially extending member vertically along a "y" axis.

* * * * *